US005429369A

United States Patent [19]

Hurst

[11] Patent Number: 5,429,369

[45] Date of Patent: Jul. 4, 1995

[54] EDUCATIONAL BOARD GAME WITH WATER SPOUT

[76] Inventor: Dereck L. Hurst, 16500 Quarry, Apt. 457, Southgate, Mich. 48195

[21] Appl. No.: 344,947

[22] Filed: Nov. 25, 1994

[51] Int. Cl.[6] ..... A63F 3/00

[52] U.S. Cl. ..... 273/243; 273/287

[58] Field of Search ..... 273/282.1, 287, 429–432, 273/457, 119 B, 243

[56] References Cited

U.S. PATENT DOCUMENTS

| | | | |
|---|---|---|---|
| 464,887 | 12/1891 | McConaughy | 273/119 B |
| 3,113,776 | 12/1963 | Romei | 273/119 B |
| 3,643,953 | 2/1972 | Fixler | 273/119 B |
| 3,831,946 | 8/1974 | Denalsky . | |
| 3,907,301 | 9/1975 | Adcock et al. | 273/287 X |
| 4,113,259 | 9/1978 | Sands | 273/287 X |
| 4,738,888 | 4/1988 | Pantaleo et al. | 273/457 X |
| 5,066,016 | 11/1991 | O'Neill | 273/249 |
| 5,112,057 | 5/1992 | Popovic | 273/243 |
| 5,121,927 | 6/1992 | Jones | 273/260 X |
| 5,121,928 | 6/1992 | Salerno-Sonneberg | 273/243 |
| 5,263,714 | 11/1993 | Rudell et al. | 273/457 X |

FOREIGN PATENT DOCUMENTS

| | | | |
|---|---|---|---|
| 2049443 | 12/1980 | United Kingdom | 273/457 |

*Primary Examiner*—William E. Stoll

*Attorney, Agent, or Firm*—Barnes, Kisselle, Raisch, Choate, Whittemore & Hulbert

[57] ABSTRACT

An educational board game requires players to answer trivia or to perform various feats based on natural sciences. The game combines question and answer problems along with action to create an exciting learning experience. The excitement is enhanced by a positionable water spout on the game board that can be moved to direct a stream of water at a player who answers or performs wrongly. A remote water tank with a water pump located therein is connected to the water spout and is actuated by a player's opponent.

9 Claims, 2 Drawing Sheets

EDUCATIONAL BOARD GAME WITH WATER SPOUT

FIELD OF THE INVENTION

This invention relates generally to board games and more particularly to an educational board game with a positionable water spout.

BACKGROUND OF THE INVENTION

As is well known, game boards have been in existence for many years. These games have been used for entertainment purposes as well as for education by adults and children alike. Most game boards simply require a player to move a game piece around the board in a predetermined manner. In the recent past, trivia games have become popular requiring players to answer questions on general knowledge of a wide variety of subjects. Still other games are well known, such as "charade" type games requiring the participant to act out words, phrases or titles.

SUMMARY OF THE INVENTION

A new game board combines various aspects of a typical board game, the trivia type games and the charade type games. In particular, this invention comprises a game board directed to the natural sciences where each player is required to move around the board and depending on where the game piece lands, draw a card corresponding in color to the space upon which the game piece rests. The cards are drawn from several stacks, each requiring the player to perform a specific act or answer questions directed to specific categories. For example, cards taken from the "action" pile require the player to act out a subject of the natural sciences in pantomine fashion whatever the card requires. A card taken from the "aquatic" pile requires the player to answer questions specifically to anything aquatic in nature, including sea life, rivers, lakes or rain. The cards taken from the "trivia" pile requires the player to answer general trivial facts of the natural sciences.

The excitement of the game is enhanced by a positionable water spout located centrally of the game board which is aimed at the player that is required to provide a correct answer. If the player is unable to correctly answer what is required in the amount of time provided, a stream of water is directed at the player by a water pump operated by another player.

BRIEF DESCRIPTION OF THE DRAWINGS

These and other objects, features and advantages of the invention will be apparent from the following detailed description, appended claims and accompanying drawings in which:

DETAILED DESCRIPTION

Figure 1:
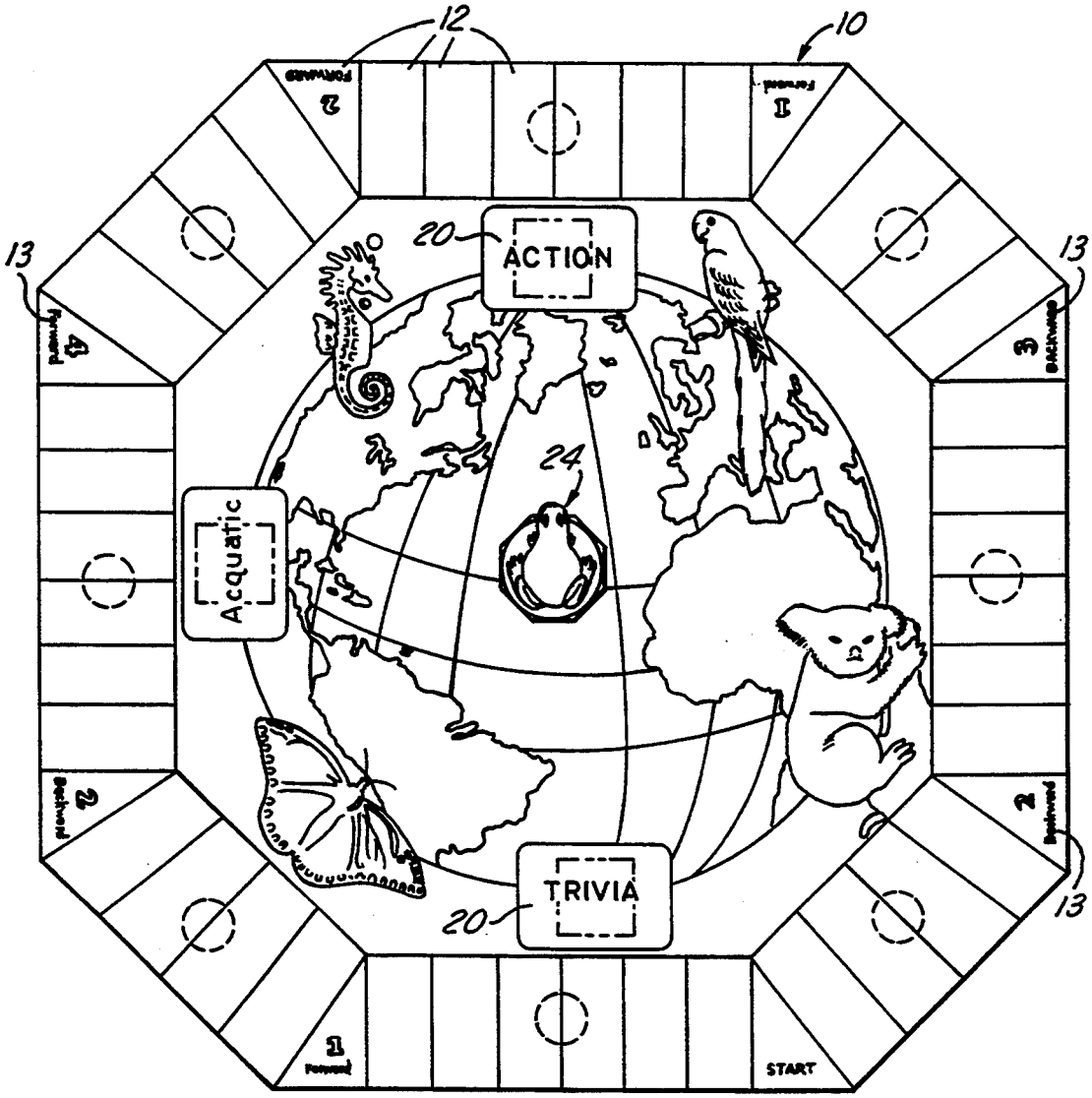
FIG. 1 is a plan view of the game board of the present invention.
Figure 4:
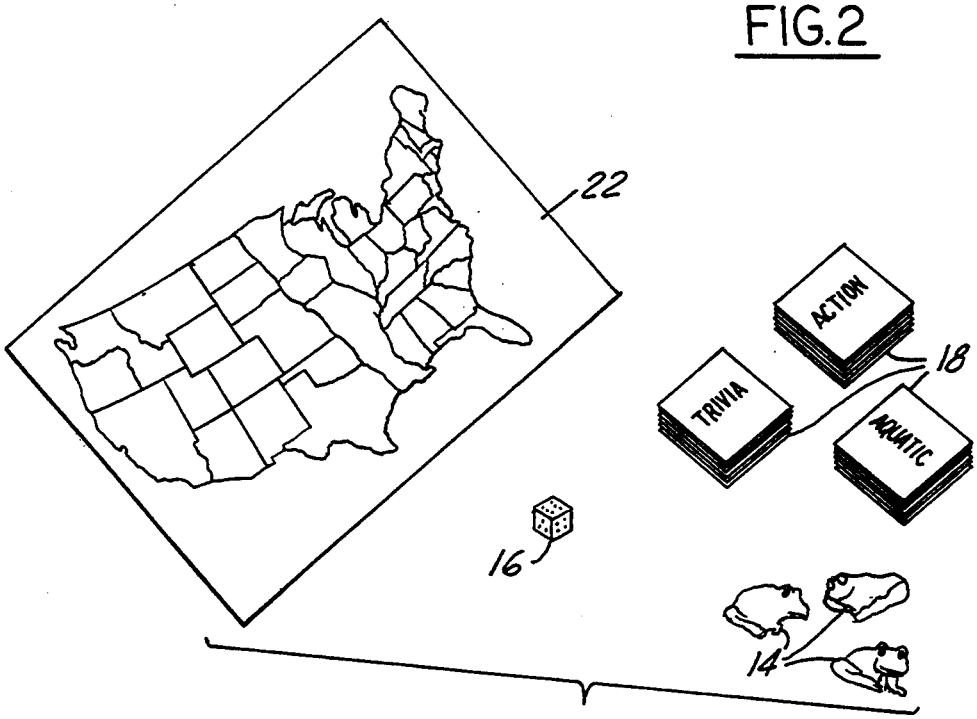
FIG. 4 is a perspective view of the various game elements used in play.

Referring now to the drawings, and more particularly to FIGS. 1 and 4, a game board 10 has a path of discrete differently colored spaces 12, some of which have indicia 13 thereon for instructing a player in movement of a game piece 14 around the board 10. Each game piece 14 represents a different player and is advanced around the board 10 by the roll of a die 16. The spaces 12 are alternately colored to correspond to the color of cards 18 which are grouped in specific categories and placed on the board 10 and the card spaces 20. For example, the cards labeled "trivia" may be colored red and placed in the card space on the board 10 labeled "trivia" so that as a player advances his or her game piece to a red space, the player draws the red trivia card and must follow the instructions on the card. Such instructions in the trivia category generally require the player to answer various questions of a natural science related topic. Similarly, the cards labeled "aquatic" may be colored blue so that as a player lands on a blue space, an aquatic card must be drawn in which the player must follow the instructions thereon. This category generally deals with questions regarding any water related facts, such as, for example, specifics of sea life, rivers, lakes, rain, snow or hail, etc. The "action" category may be colored yellow, for instance, so that as a player lands on a yellow space, the player is required to follow the instructions on the action card which might require the player to act out in pantomine fashion whatever natural science related topic is given. A map 22 of the United States may also be included to assist in answering a certain question or for when a player is required to locate a specific state.

Located centrally of the board 10 is a positionable water spout 24 that is movable through a range of preferably 180° and can be tilted up and down to be aimed at a player who is required to provide an answer. If the player answers wrong or does not answer within the required amount of time, one of the player's opponents directs a stream of water onto the player.

Figure 3:
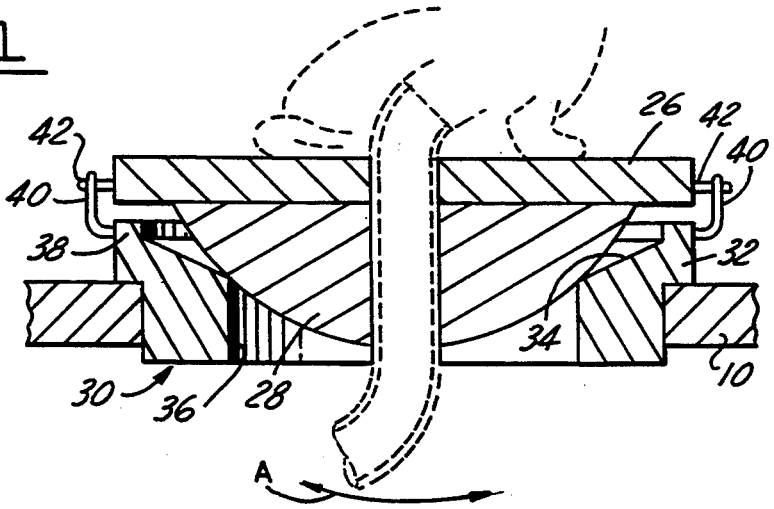
FIG. 3 is an enlarged cross-sectional view of the platform and mount.
Figure 2:
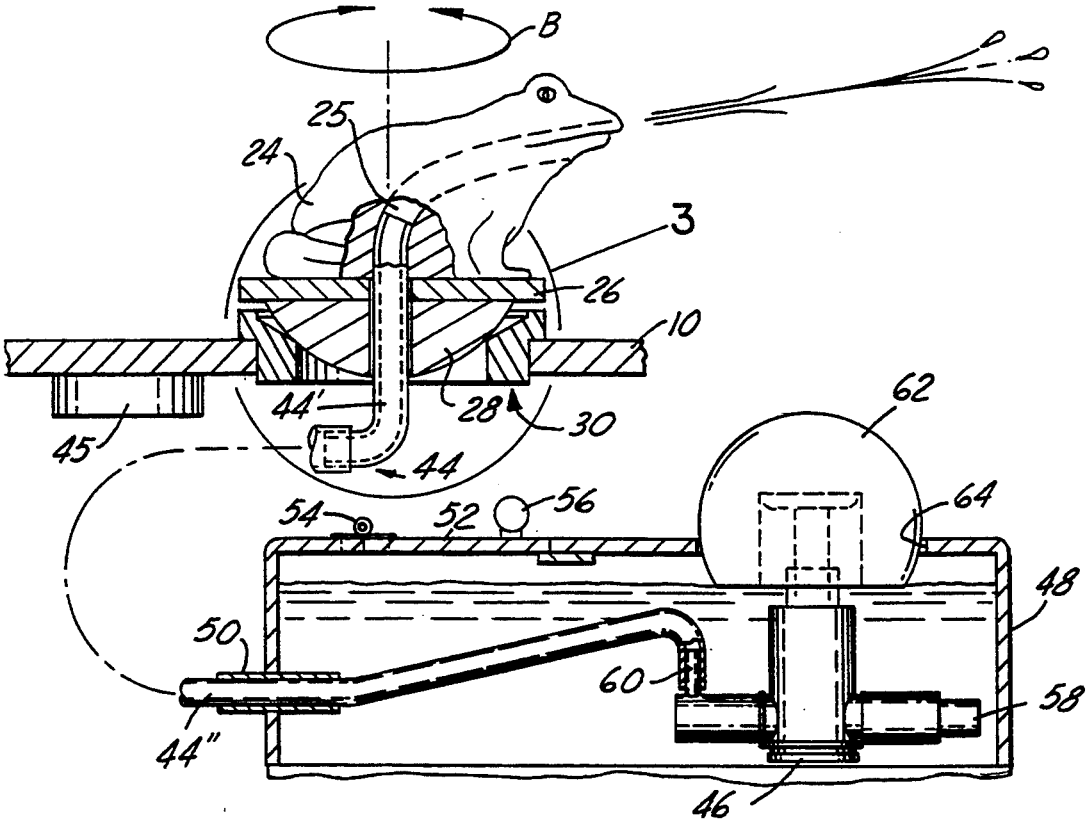
FIG. 2 is a partial cross-sectional view of the game board with the water spout platform located therein and of the remote water pump.

The water spout 24 has a central passage 25 and is shown preferably in the form of a frog, or "Grippet", which sits on a flat platform 26 having a spherical lower portion 28. The platform 26 is preferably seated in a non-circular non-rotatable annular base 30. The base is shown in FIG. 1 as being octagonal in shape; however, it is to be understood that any non-circular shape could be used. The base 30 is mounted in a corresponding opening in the board 10 and has an upper seat portion 32 having a radially inwardly slanting seat 34 ending in a central through opening 36. The point at which the slanting surface 34 meets the central through opening actually forms the seat upon which the spherical portion sits and forms a diameter substantially less than the diameter of the spherical portion 28 so as to keep the platform 26 spaced from the base 30. This spacing allows the base to be tiled about the arrow "A" (FIG. 3) until the base 26 contacts the upper portion 38 of the base 30. Additionally, the platform 26 can be rotated as shown by arrow "B" (FIG. 2) about an angle of about 180°. Preferably, the base 30 has stops 40 against which an abutment 42 on the platform 26 contacts to prevent further rotation.

The water spout 24 is connected through a hose 44 to a remote water pump 46 located within a water tank 48. Preferably, the hose 44 can be sectioned into two portions 44' and 44''. The two sections 44' and 44'' may be attached simply by squeezing one end of the portion 44' into an adjacent end of the section 44'' to frictionally hold the two sections together. The section 44' may be either permanently secured, such as by gluing, in the water spout 24 within the passage 25. Alternatively, the diameter of the passage 25 may be slightly smaller than the diameter of the hose portion 44' so that it is frictionally retained therein. As the water spout 24 sits on the platform 6, the hose portion 44' extends through an opening extending all the way through the platform 26 and spherical portion 28 to extend underneath the board 20 which is elevated by a plurality of feet 45 for connection with the section 44" . The portion 4" extends through a seal 50 to extend into the water tank 48 for connected to the water pump 46.

The water pump 48 is filled with water through an opening usually covered by a hatch 52 attached by a hinge 54 to the tank 48 and can be opened by a handle 56. The pump 46 is located within the tank 48 and has an inlet 58 and an outlet 60 which is connected to the hose 44. An actuator 62 extends outside of the tank 48 through an opening 64 therein for easy access by a player.

In use, when a player gives a wrong answer, an opponent positions the water spout 24 by turning it about the arrow B on the base 30 and, if necessary, tilting about the arrow A to aim the water spout at the opposed player, and actuates the water pump by depressing the actuator 62 to direct a stream of water at the opposed player.

I claim:

1. An educational board game for playing a game related to natural sciences comprising a game board having a game playing surface, a water nozzle movably mounted on said game board to extend above the playing surface for manual positioning at various locations, a remote water tank for holding a water supply, and a manual pump located in said tank and connected to said nozzle for pumping water to said nozzle to direct a stream of water at a player.

2. The board game of claim 1 comprising a non-rotatable annular base removably mounted on said game board, a platform movably mounted on said base, wherein said nozzle sits on said platform to move along therewith.

3. The board game of claim 2 wherein said game board has a non-circular opening therein, and said base comprises a non-circular portion that conforms to the opening in said game board and a seat portion, said annular portion being received in the opening in said game board so that said seat portion extends above the playing surface.

4. The board game of claim 3 wherein said platform comprises a lower spherical surface removably located within the seat portion of said base so that said platform is spaced from the seat portion of said base so that said platform can rotate and tilt within the seat portion of said base.

5. The board game of claim 2 wherein said nozzle is connected to said pump by a flexible hose through which water travels.

6. The board game of claim 5 wherein said platform has an opening extending therethrough so that said hose extends from said pump through the opening to said nozzle.

7. The board game of claim 2 wherein said base and said platform have abutment stops for limiting rotation of said platform therein.

8. The board game of claim 1 comprising a plurality of discrete adjoining spaces on said game board surface, a plurality of game pieces each representing a player for moving on said spaces, a plurality of instruction cards divided into multiple categories wherein the cards in each said category correspond to a specific space on said game board surface, each said card having indicia thereon providing playing instructions directing a player whose game piece falls on said specific space to act in accordance with said indicia wherein the player may act correctly or incorrectly, and said water nozzle positioned at a preselected location aimed at the player who is to act in accordance with said indicia to direct a stream of water at such player in the event of incorrect action.

9. A method of playing a natural science-related game comprising the steps of providing a game playing board having discrete adjoining spaces, providing a plurality of game pieces each representing a player for movement on said spaces, providing a plurality of instruction cards corresponding to specific spaces, each card having indicia thereon to direct a player whose game piece lands on a corresponding space to act in accordance with the indicia, so that such player may act correctly or incorrectly, and providing a water nozzle positionable to direct a stream of water and directing a stream of water onto such player in the event of incorrect action.

* * * * *